United States Patent [19]

Newhouse

[11] Patent Number: 4,515,272

[45] Date of Patent: May 7, 1985

[54] ROSIN BAR HOLDER

[76] Inventor: Denis P. Newhouse, 18439 Algonac, Detroit, Mich. 48234

[21] Appl. No.: 480,100

[22] Filed: Mar. 29, 1983

[51] Int. Cl.[3] ..... B65D 81/02; B65D 85/00

[52] U.S. Cl. ..... 206/592; 84/453; 206/591; 220/448; 401/88

[58] Field of Search ..... 84/453; 206/521, 522, 206/523, 524, 560, 562, 563, 564, 586, 587, 588, 591, 592; 217/25.5, 35, 52; 220/448, 902; 401/88

[56] References Cited

U.S. PATENT DOCUMENTS

| | | | |
|---|---|---|---|
| 1,626,425 | 4/1927 | Pelsue . | |
| 2,603,032 | 7/1952 | Huber | 45/28 |
| 3,121,522 | 2/1964 | Ragnow | 220/902 |
| 3,471,116 | 10/1969 | Cherrie | 206/320 |
| 3,521,808 | 7/1970 | Weiss | 206/564 |
| 3,802,555 | 4/1974 | Grasty et al. | 206/564 |
| 4,201,293 | 5/1980 | Rigazio et al. | 206/523 |

FOREIGN PATENT DOCUMENTS

| | | | |
|---|---|---|---|
| 1467166 | 12/1966 | France | 206/523 |
| 1207592 | 10/1970 | United Kingdom | 229/15 |

*Primary Examiner*—George E. Lowrance
*Assistant Examiner*—Jimmy G. Foster
*Attorney, Agent, or Firm*—Basile, Weintraub & Hanlon

[57] ABSTRACT

A holder for solid articles in the form of a body having sidewalls, an integral bottom and an open top. The body is formed of a shock absorbing material. A plurality of spaced, outwardly extending ribs are formed on certain of the sidewalls and bottom of the body resiliently protect articles housed in the body to from damage. The sidewalls are formed with an inwardly extending upper lip portion which overlays a portion of the article within the body to secure the article within the body. A pair of opposed depending apertures contiguous with the open top are in certain of the sidewalls of the body.

6 Claims, 3 Drawing Figures

ROSIN BAR HOLDER

BACKGROUND OF THE INVENTION

1. Field of the Invention

This invention relates, in general, to article holders and, more specifically, to holders for solid, brittle articles.

2. Description of the Prior Art

Holders have been devised to receive and contain a variety of articles in order to protect such articles from damage, external forces or changes due to environmental effects. Holders or containers have also been devised to protect brittle articles, i.e., bottles or other objects made from glass, from breakage if accidentally dropped or subjected to external forces.

However, holders for string instrument rosin bars or cakes have not been previously devised which are capable of preventing damage or breakage of the brittle bar when the bar is accidentally dropped or struck. Rosin bars or cakes are used on the bowhairs of certain types of string instruments, such as violins, cellos and violas, by drawing the bowhair across the bar.

Rectangular-shaped rosin bars are typically available in an open-ended three-sided container made of wood. Such containers enable the bar to be used without the user having to touch the bar itself. However, the wood containers provide no protection for the brittle bar if the bar is accidentally dropped or struck. Circular-shaped rosin bars and cakes are typically sold in a cloth or leather covering which, again, provides no shock protection for the brittle rosin bar or cake.

Since rosin bars are only available in containers which provide little shock protection for the brittle bars, the bars are easily and frequently shattered into numerous unusable pieces or cracked into several large pieces which will fall out of the container in a short time and could cause damage to the bowhair of the string instrument. Presently available containers for rosin bars also have several other drawbacks. The three-sided, open-ended container does not provide any guide for drawing the bowhair across the bar particularly when the bar is new and its top surface is flush with the upper sides of the container. When the rosin bar is new, it is possible for the bowhair to catch in the crack between the side edge of the rosin bar and the upper side of the container which could easily break or damage the bowhair of the string instrument. In those rosin bars which are sold without any container at all, there is no guide for the bowhair as it is drawn across the bar such that the bowhair could strike the fingers of the user or slip off of the rosin bar altogether unless extreme care is exerted by the user.

Thus, it would be desirable to provide a holder for brittle articles which protects such articles from inadvertent damage or breakage. It would also be desirable to provide an article holder which enables easy insertion and removal of the article therefrom. It would also be desirable to provide an article holder which is inexpensive to manufacture.

It would further be desirable to provide an article holder for use with string instrument rosin bars which enables such bar to be used while in the holder and which holder provides shock absorbing protection for the brittle rosin bars.

SUMMARY OF THE INVENTION

The present invention is a holder for solid articles which protects such articles from inadvertent damage or breakage if dropped. The holder is in the form of a body having opposed sidewalls, an integral bottom, and an open top. The body is formed of a resilient, shock absorbing material, such as rubber or a resilient thermoplastic material.

The body includes a plurality of spaced, outwardly extending external ribs which are formed on certain of the sidewalls and the bottom to resiliently protect articles which are contained within the body from breakage or damage if the article holder is dropped or struck. Preferably, a pair of opposed apertures or slots are formed in the sidewalls and extend downward from the open top. The sidewalls have an inwardly extending lip portion formed at an upper end which defines an opening along a top end of the body for removably receiving and securing an article within the article holder.

The article holder of the present invention overcomes many of the problems encountered with previously devised holders for articles and especially brittle articles which are susceptible to easy breakage or damage when dropped or struck by an external force. The article holder of the present invention is formed of a resilient, shock absorbing material which provides shock protection for articles housed therein if the article holder is accidentally dropped. The article holder is also uniquely configured so as to enable articles to be easily inserted and removed therefrom. Furthermore, the article holder enables certain types of articles housed therein to be used while still retained within the holder.

The article holder of the present invention finds particular advantageous use with string instrument rosin bars which are extremely brittle and subject to frequent breakage which has previously limited their useful life. By forming a pair of opposed apertures in the sidewalls of the article holder, the rosin bar housed within the holder can be used while being retained in the holder. This enables the user to draw the string instrument bowhair across the rosin bar without his fingers having to touch the bar and, further, prevents minute airborne particals released from the bar when the string instrument bowhair is drawn thereacross from contacting the user's fingers.

The outwardly extending external ribs formed on the exterior of the sidewalls and bottom of the article holder in one embodiment of the present invention provide shock protection for articles, such as a rosin bar, housed within the holder as well as providing a convenient gripping surface which will minimize droppage of the article holder.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
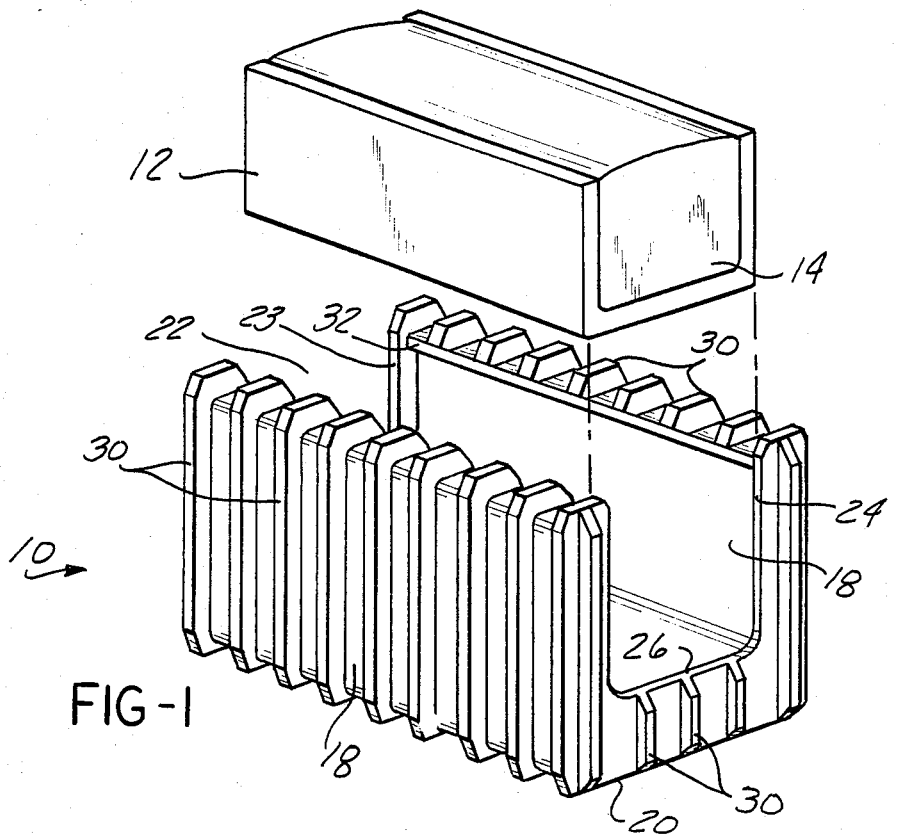
FIG. 1 is a perspective view of an article holder constructed in accordance with the teachings of the present invention.

Throughout the following description and drawing, an identical reference number is used to refer to the same component shown in the multiple figures of the drawing.

Referring now to the drawing, and to FIG. 1 in particular, there is illustrated an article holder 10. The article holder 10 of the present invention is suited for removably receiving and containing any type of article. However, the article holder 10 is preferably configured for removably receiving and supporting brittle articles, such as a string instrument rosin bar, shown in FIG. 1 and denoted in general by reference number 14.

As is conventional, such rosin bars 14 are sold in a three-sided, open-ended holder 12. The holder 12 is typically formed of wood which does little to protect the brittle rosin bar 14 from breakage or damage if it is inadvertently dropped.

Figure 2:
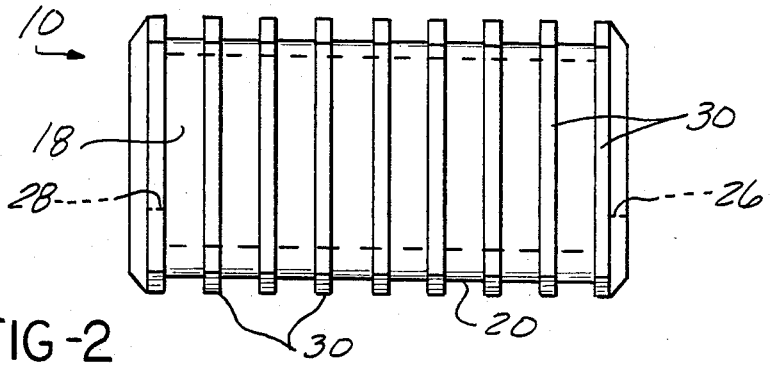
FIG. 2 is a side elevational view of the article holder shown in FIG. 1.
Figure 3:
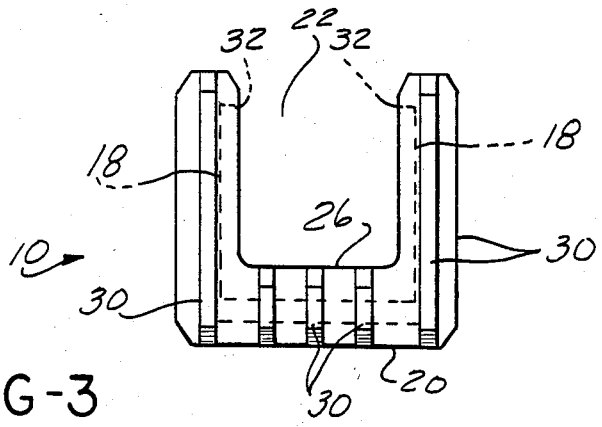
FIG. 3 is an end view of the article holder shown in FIG. 1.

As shown in FIGS. 1, 2 and 3, the article holder 10 of the present invention comprises a body which is formed of a shock absorbing material. Preferably, the body of the article holder 10 is formed of a resilient, shock absorbing material to provide shock protection for articles housed therein. Even more preferably, the body is formed of a flexible, resilient, shock absorbing material, such as rubber, sponge rubber, a foamed plastic material or other flexible, resilient plastic material.

As depicted in the drawing and described hereafter, the body is formed in a rectangular configuration. However, it will be understood that other configurations are also possible and may include square, circular, etc., shapes as well. The body is formed with upstanding sidewalls 18, a bottom 20 and an open top end 22. A pair of opposed apertures, preferably in the form of slots 23 and 24 are formed in the sidewalls 18 and extend downward from the open top end 22. The apertures or slots 23 and 24, which are aligned across the body of the holder 10, facilitate an easy insertion and removal of articles within the interior of the body as well as enabling certain types of articles housed within the body to be used while still retained within the article holder 10.

In a preferred embodiment illustrated in FIGS. 1, 2 and 3, the body has a rectangular configuration formed with opposed sidewalls 18, a bottom 20 and opposed end walls 26 and 28. The end walls 26 and 28 have a shorter heighth than the sidewalls 18 and are formed at the lower portion of the downwardly extending apertures 23 and 24, respectively, in the sidewalls 18 of the body of the article holder 10.

As shown in FIGS. 1, 2 and 3, an inwardly extending lip 32 is formed at the upper edge of the sidewalls 18 of the body of the article holder 10. The lip portion 32 extends inwardly from each sidewall 18 over the internal cavity formed within the body of the article holder 10 and overhangs the sidewall 18. The lip portions 32 overlay a portion of the articles housed therein so as to securely retain the articles within the article holder 10, and yet enable easy removal of the article from the article holder 10 due to the resilient, flexible material used to construct the article holder 10.

As shown in FIGS. 1, 2 and 3, a plurality of ribs 30 are formed on the exterior of the body of the article holder 10. The ribs 30 extend outward from the body and are spaced apart about the exterior surface of the body.

The ribs 30 are integrally formed with the body and are disposed on certain of the sidewalls 18 and the bottom 20. Preferably, the ribs 30 are formed on all of the exterior surfaces of the body and extend completely from one lip portion 32, one sidewall 18, across the bottom 20 and along the opposed sidewall 18 and lip portion 32 so as to completely surround articles housed within the body of the article holder 10.

The ribs 30, along with the shock absorbing material used to form the body, cooperate to protect the articles housed within the body from breakage if the body is inadvertently dropped. Furthermore, the ribs 30 provide a convenient gripping surface which facilitates handling of the body so as to prevent inadvertent mishandling.

In summry, there has been disclosed a unique article holder which is particularly configured for protecting brittle articles, such as string instrument rosin bars, from breakage if the article holder is inadvertently dropped or subjected to external forces. The article holder is formed of a shock absorbing material and, in a preferred embodiment, has ribs formed on the external surfaces thereof which provide protection for articles housed within the article holder if it is inadvertently dropped. The article holder of the present invention is integrally formed in a single piece assembly which is inexpensive to manufacture. Furthermore, the article holder enables easy insertion and removal of articles from the interior thereof. Finally, the open top and contiguous opposed, depending apertures formed in the sdiewalls of the article holder enable certain articles, such as rosin bar, to be used while housed within the article holder.

What is claimed is:

1. A rosin bar holder comprising:

a body having sidewalls, end walls, a bottom and an open top defining an internal cavity for removably receiving a rosin bar, the internal cavity having a shape complementary to the shape of the rosin bar;

inwardly extending lips formed at the upper ends of the sidewalls overlaying the internal cavity in the body to secure a rosin bar therein; and aligned aperture means formed in the end walls of the body and extending from the open top for enabling an article to be used for its intended purpose while being housed in the body, said aperture being of less width and height than the internal cavity to further secure a rosin bar therein; and the body being formed of a shock absorbing and resilient material for protecting the rosin bar housed here in from damage from external forces and to enable the sidewalls to be resiliently urged outward for removable insertion of a rosin bar into the body.

2. The rosin bar holder of claim 1 wherein the aperture means includes first and second opposed apertures formed in the sidewalls.

3. The rosin bar holder of claim 1 further including:

a plurality of outwardly extending external ribs formed on certain of the sidewalls end walls and bottom.

4. The rosin bar holder of claim 3 wherein:

the ribs extend continuously across the sidewalls and the bottom of the holder.

5. The rosin bar holder of claim 6 further including a plurality of outwardly extending ribs. formed on the lips.

6. The combination of a holder and a rosin bar for stringed instrument bow strings comprising:

a body having sidewalls, end walls, a bottom and an open top, defining a internal cavity for removably receiving the rosin bar, the internal cavity having a shape complementary to the shape of the rosin bar;

inwardly extending lips formed at the upper end of the sidewalls overlaying the internal cavity in the body to secure the rosin bar therein;

aligned aperture means formed in the end walls of the body and extending from the open top for permitting a bow string to be drawn across the rosin bar while the rosin bar is in the body, said aperature being of less width and height than the internal cavity to further secure the rosin bar therein; and the body being formed of a shock absorbing and resilient material for protecting the rosin bar housed therein from damage from external forces and to enable the sidewalls to be resiliently urged outward for removable insertion of the rosin bar into the body.

* * * * *